US005218170A

United States Patent [19]

Ferlier et al.

[11] Patent Number: 5,218,170

[45] Date of Patent: Jun. 8, 1993

[54] ELONGATE BODY INSULATED BY MEANS OF AN INSULATING COVERING

[75] Inventors: Jean-Pierre Ferlier, Yerres; Michel Marechal, Combs la Ville, both of France

[73] Assignee: Alcatel N.V., Amsterdam, Netherlands

[21] Appl. No.: 839,130

[22] Filed: Feb. 21, 1992

[30] Foreign Application Priority Data

Feb. 22, 1991 [FR] France ..... 91 02161

[51] Int. Cl.[5] ..... H01B 7/00; H01B 7/34

[52] U.S. Cl. ..... 174/120 R; 138/129; 138/144; 174/110 SR; 174/110 N; 174/110 FC; 174/120 C; 174/120 SR

[58] Field of Search ..... 174/120 R, 120 C, 120 SR, 174/110 FC, 110 N, 110 SR, 110 R, 107, 36; 138/154, 144, 129

[56] References Cited

U.S. PATENT DOCUMENTS

| | | | |
|---|---|---|---|
| 3,488,537 | 1/1970 | Beddows | 174/120 R |
| 3,617,617 | 11/1971 | Katz | 174/120 SR |
| 4,094,715 | 6/1978 | Henderson et al. | 138/144 X |
| 4,471,022 | 9/1984 | McGregor et al. | 174/110 N X |
| 4,851,060 | 7/1989 | Wade, Jr. et al. | 174/110 SR X |
| 4,900,879 | 2/1990 | Buck et al. | 174/120 R |
| 5,061,554 | 10/1991 | Hjortsberg et al. | 428/220 |

FOREIGN PATENT DOCUMENTS

| | | |
|---|---|---|
| 0363064 | 4/1990 | European Pat. Off. . |
| 1571555 | 6/1969 | France . |
| 7142298 | 8/1972 | France . |
| 2555799 | 5/1985 | France . |
| 902567 | 8/1962 | United Kingdom . |
| 1203484 | 8/1970 | United Kingdom . |
| 1362179 | 7/1971 | United Kingdom . |

*Primary Examiner*—Morris H. Nimmo
*Attorney, Agent, or Firm*—Brunell & May

[57] ABSTRACT

An elongate body insulated by means of an insulating covering, said covering being constituted by a tape (2) made of synthetic material taped around said body (1) and covered in a layer of varnish (11) made of synthetic material, the body being characterized in that the taping is such that there exists a groove (4) between the free edge (5) of any portion of a turn (3) that is not covered by the following turns and the uncovered surface (6) of the preceding turn, the width of said groove (4) lying substantially in the range 0% to 5% of the width of said tape (2) and being strictly greater than zero.

14 Claims, 2 Drawing Sheets

ELONGATE BODY INSULATED BY MEANS OF AN INSULATING COVERING

The present invention relates to an elongate body insulated by means of a covering of insulating material.

The term "elongate body" is used to cover any body that is long relative to its diameter. The term "elongate body" can thus be used, for example, for electrical conductors or cables of all kinds, hollow section bars, tubes, pipes, and more generally ducting.

The present invention relates in particular to insulating cables or electrical conductors. The specification below relates to electrical conductors.

French patent application FR-2 119 939 describes an electrical conductor insulated by means of taping with an overlap percentage of not less than 50% using a tape made of synthetic material. The tape is then covered in varnish made of a dried and cured synthetic material. The preferred overlap percentages mentioned in that document lead in practice to taping with overlaps or steps that cause the radial thickness of the conductor to be irregular, such that it is not possible to obtain a smooth outer surface.

The overlaps also form projecting edges which constitute points of attack for external mechanical forces. This may give rise to the insulation being torn off at an overlap zone, thereby possibly exposing the conductor to high temperatures, to the influence of moisture, or to a chemically aggressive medium.

The same problems as those mentioned above arise when any elongate body is to be insulated.

The object of the present invention is to provide an elongate body having taped insulation and a smooth outside appearance.

To this end, the present invention provides an elongate body insulated by means of an insulating covering, said covering being constituted by a tape made of synthetic material taped around said body and covered in a layer of varnish made of synthetic material, the body being characterized in that the taping is such that there exists a groove between the free edge of any portion of a turn that is not covered by the following turns and the uncovered surface of the preceding turn, the width of said groove lying substantially in the range 0% to 5% of the width of said tape and being strictly greater than zero.

Advantageously, the width of said groove is substantially equal to 1% of the width of said tape. This value makes its possible for the varnish to adhere thoroughly in the grooves before coating the tape.

The layer of varnish may be deposited by immersion in a bath containing the varnish followed by heat treatment such as sintering for eliminating the volatile substances contained in the varnish and for curing the varnish.

According to an additional feature, the varnish contains wetting agents suitable to enable it to adhere to the surface which it covers prior to the heat treatment.

The layer of varnish may also be deposited by an electrostatic method or by a fluidized bed method.

The invention may be applied, for example, to the outer insulation of electrical cables, electrical conductors, tubes, pipes, or ducts.

It may also be applied to the manufacture of hollow section bars, in which case the elongate body is a support body that is removed once the heat treatment has been terminated.

The electrical cables, electrical conductors, tubes, pipes, ducts, or hollow section bars obtained in this way have a smooth outer surface and concentricity greater than 90%.

Other characteristics and advantages of the present invention appear from the following description of an electrical conductor whose insulating covering is in accordance with the invention, and given by way of non-limiting illustration.

Figure 1:
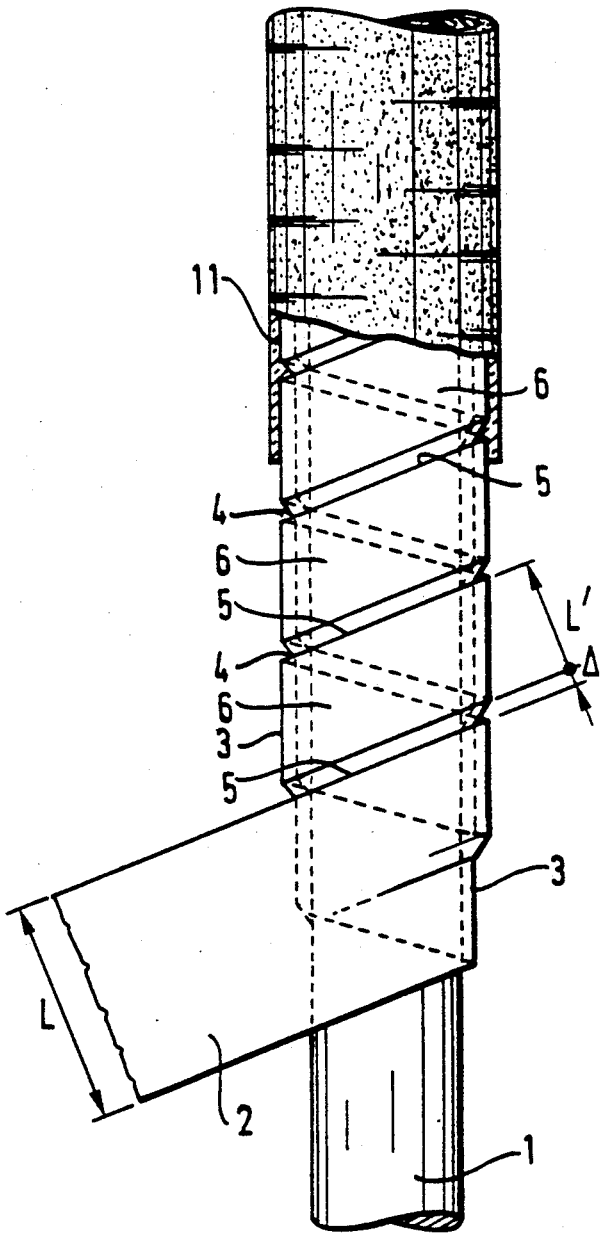
FIG. 1 shows an electrical conductor (or wire for cabling) whose insulating covering is in accordance with the invention.
Figure 2:
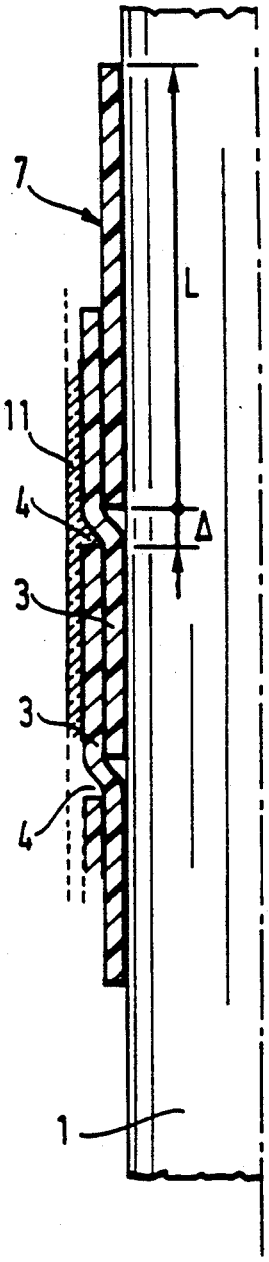
FIG. 2 is an enlargement of portion II in FIG. 1.

In FIGS. 1 and 2, a conductor 1 (having a diameter of 1.25 mm) is covered in a PTFE tape 2 of thickness equal to 76 μm and of width L equal to about 10 mm. More precisely, the tape is taped around the conductor 1 by being helically wound at a pitch such that each turn 3 of width L has 49% of its width overlapped by the following turn, i.e. it is overlapped over a width $L'=4.9$ mm. It is then said that the overlap coefficient is 49%. Consequently, such winding leaves gaps or grooves 4 of width $\Delta=1\%$. The width between the free edge 5 of any portion of a turn that is not covered by the following turns and the uncovered surface 6 of the preceding turn is equal to 0.1 mm.

Figure 3:
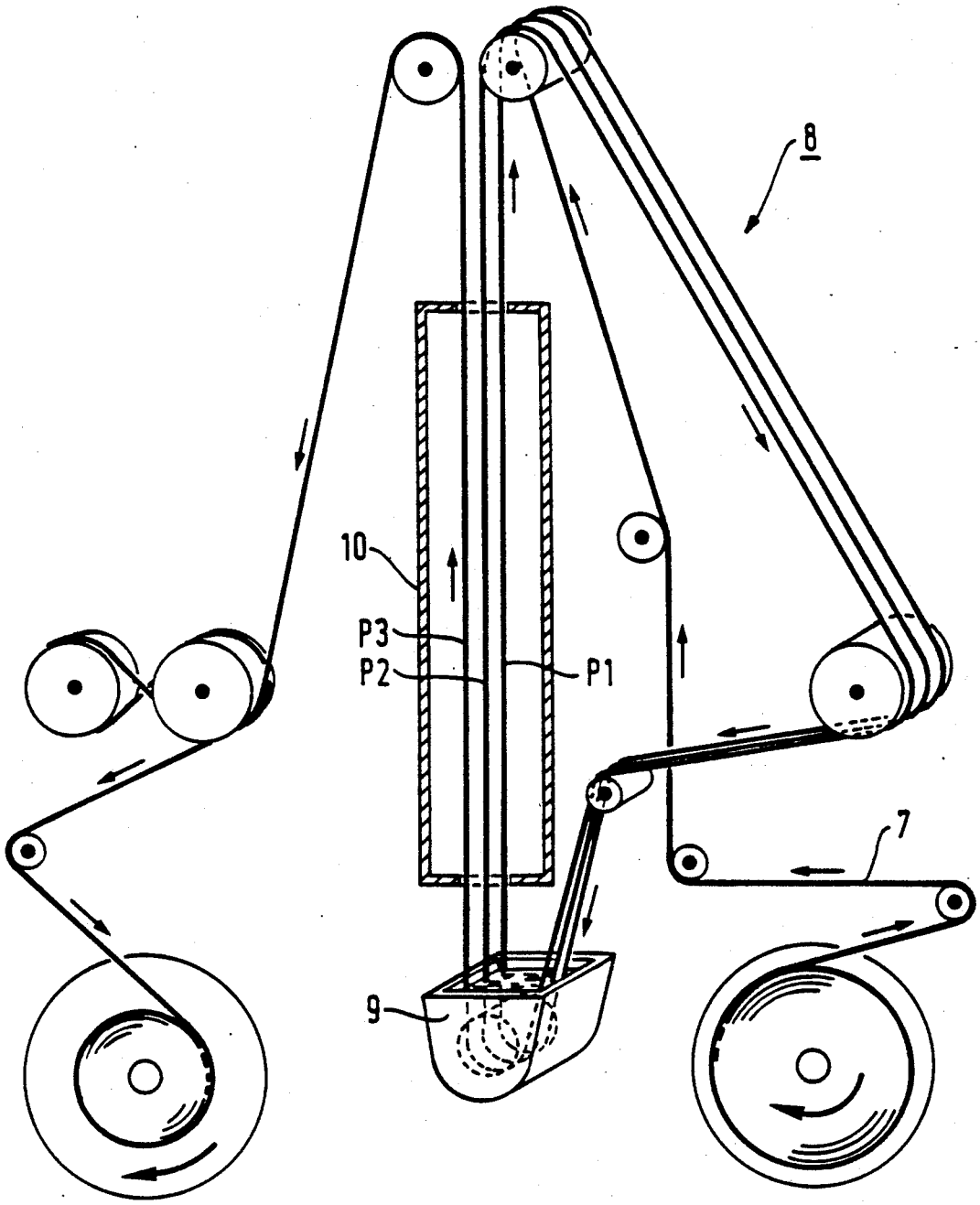
FIG. 3 is a diagram of a varnishing oven for coating the wire for cabling of the invention.

After taping, the conductor 7 obtained in this way is coated with varnish in a varnishing oven 8 (see FIG. 3). Varnishing takes place in three passes $P_1$, $P_2$, $P_3$. On each pass, the conductor 7 is immersed in a coating trough 9 containing an aqueous dispersion (or varnish) of polytetrafluoroethylene (PTFE) to which wetting agents are added. These wetting agents are adapted to PTFE varnish such that when the conductor 7 is removed from the trough 9, the still-liquid varnish fills the grooves 4 and laps the conductor 7 while adhering to the surface of the conductor and not "running" as would occur if the width of the gaps were ill-adapted and if the surface tension created by the wetting agents were not optimized.

The conductor 7 coated in PTFE varnish is then subjected to heat treatment (or sintering) in a vertical tower oven 10 for eliminating the solvents and for curing the varnish.

After the first pass (immersing and sintering), two further similar passes $P_2$ and $P_3$ are performed so as to obtain a protective layer corresponding to the desired specifications for radial thickness and for operating voltage.

The above description of one particular way of applying varnish is naturally given purely as an indication. The varnish may be applied in any other manner that is conventional in this field; it may thus be applied by an electrostatic method or by a fluidized bed method.

The final cabling wire obtained thus has an outer layer of varnish 11 coating the taping and included in the grooves 4. The thickness of this layer of varnish lies in the range 27 μm to 36 μm. Because of the varnish coating and the presence of narrow gaps, the outside appearance of the cabling wire is smooth, offering no points of attack for mechanical forces which could tear off or open the insulating covering, and retaining the good concentricity characteristic of taped conductors, i.e. better than 90%.

Unlike prior art cabling wires, cabling wires of the invention also have narrow gaps that enable the varnish to avoid sliding along the tape so that it fills the grooves formed prior to the tape being coated, thereby establishing a smooth covering.

Furthermore, the manufacture of cabling wires of the invention does not require any complex modification to conventional technology. A conventional taping disk is used merely by adapting its taping pitch to the desired overlap coefficient, and varnishing is likewise performed using a conventional technique. The resulting product is of improved quality, and its electrical, chemical, and operating voltage characteristics are identical to those of prior art extruded or taped insulation cabling wires. In particular, the outer insulation obtained is capable of withstanding electrical and mechanical stresses.

Naturally, the present invention is not limited to the implementation described above.

Firstly, the width of the gap is not necessarily equal to 1% of the width of the tape, and it may preferably take any value lying in the range 0% to 5%, while always being strictly greater than 0%. For a width greater than 5% of the width of the tape, there is a risk of the varnish sliding over the taping without filling its gaps, even when wetting agents are present. It would therefore be more difficult to obtain an insulating covering that is smooth.

The description above also relates to a cabling wire in which the tape and the varnish are based on the same material, but it is possible for the tape and the varnish to be made of different materials, providing those materials are mutually compatible and the varnish is capable of adhering to the tape.

For example, a PTFE tape may be used with a varnish comprising an aqueous solution of a fluorinated copolymer of ethylene and propylene (FEP), or a polyamide tape (such as "Kapton"—registered trademark) with a varnish of polyurethane or of polyamide, or finally a polyester tape with a varnish of nylon or of polyester.

In addition, the invention may be applied to a structure other than a cabling wire, for example it may be applied to a coaxial cable whose outer insulating covering is constituted by a composite tape of polyamide and of PTFE and a varnish of PTFE or of FEP. Naturally all of the above-mentioned pairs of materials can also be used for making the outer covering of a coaxial cable.

For cables of non-circular section (rectangular or polygonal, for example), where it is impossible to obtain a centered outer insulation by extrusion, the invention makes it possible to obtain an insulating covering having all of the necessary qualities.

Advantageously, it is possible to coat the cable or the conductor with more than three layers of varnish. This makes it possible to fill all of the grooves completely, to achieve the desired performance with respect to operating voltage of the cable, and to establish a radial thickness of insulation that complies with the requested specifications.

In general, the invention may be applied to insulating any elongate body, and in particular to insulating all types of cable, including optical fiber cables, all kinds of electrical conductors, and possibly also pipes, tubes, or ducts whose operating environments require insulating protection having the qualities of the protection provided by the invention.

The invention may also be applied to manufacturing hollow section bars. This can be done merely by applying the insulation to a supporting body or former which is removed after the formed section bar has been made.

Clearly the numerical values given are given merely by way of example and they cannot be considered as being limiting under any circumstances. For example, the thickness of the tape may lie in the range 50 μm to 200 μm, and the width of the tape may lie in the range 7 mm to 12 mm.

Finally, any means may be replaced by equivalent means without going beyond the ambit of the invention.

We claim:

1. An elongate body insulated by means of an insulating covering, said covering being constituted by a tape (2) made of synthetic material taped around said body (1) and covered in a layer of varnish (11) made of synthetic material, the body being characterized in that the taping is such that there exists a groove (4) between the free edge (5) of any portion of a turn (3) that is not covered by the following turns and the uncovered surface (6) of the preceding turn, the width of said groove (4) lying substantially in the range 0% to 5% of the width of said tape (2) and being strictly greater than zero.

2. A body according to claim 1, characterized in that the width of said groove (4) is substantially equal to 1% of the width of said tape (2).

3. A body according to claim 1, characterized in that said tape (2) is made of PTFE, and in that said varnish is based on PTFE.

4. A body according to claim 1, characterized in that said tape (2) is made of PTFE, and in that said varnish is an aqueous solution of FEP.

5. A body according to claim 1, characterized in that said tape (2) is made of polyamide, and in that said varnish is selected from a varnish based on polyurethane and a varnish based on polyamide.

6. A body according to claim 1, characterized in that said tape (2) is made of polyester, and in that said varnish is selected from a nylon varnish and a polyester varnish.

7. A body according to claim 1, characterized in that said layer of varnish (11) is deposited by immersion in a bath containing said varnish, followed by heat treatment for eliminating the volatile substances contained in said varnish and for curing said varnish.

8. A body according to claim 7, characterized in that said varnish contains appropriate wetting agents enabling it to adhere to the surface it covers prior to said heat treatment.

9. A body according to claim 7, characterized in that said heat treatment is sintering.

10. A body according to claim 1, characterized in that said layer of varnish (11) is applied by an electrostatic method.

11. A body according to claim 1, characterized in that said layer of varnish (11) is applied by a fluidized bed method.

12. A body according to claim 1, characterized in that it is constituted by an electrical conductor insulated by means of said covering, and in that its outside surface is smooth having concentricity greater than 90%.

13. A body according to claim 1, characterized in that it comprises, coaxially from the inside towards the outside:

a central conductor;

an intermediate sheath of dielectric material; and an outer conductor;

in that it is insulated by means of said covering, and in that it has a smooth outside surface with concentricity greater than 90%.

14. A body according to claim 1, characterized in that it is constituted by a tube, a pipe, or a duct isolated by means of said covering and having a smooth outside surface with concentricity greater than 90%.

* * * * *